US006005461A

United States Patent [19]

Murray et al.

[11] Patent Number: 6,005,461

[45] Date of Patent: Dec. 21, 1999

[54] METHOD AND APPARATUS FOR CONNECTING HIGH CURRENT RAMPING LEADS TO A SUPERCONDUCTING MAGNET

[75] Inventors: F. Scott Murray, Niskayuna; Ronald E. Hintz, Corinth; Michael Frantsov, Albany; Leo Blecher, Niskayuna; Philip A. Jonas, Albany, all of N.Y.

[73] Assignee: Intermagnetics General Corporation, Latham, N.Y.

[21] Appl. No.: 09/099,181

[22] Filed: Jun. 18, 1998

[51] Int. Cl.[6] ..... H01F 1/00

[52] U.S. Cl. ..... 335/216; 174/15.4; 505/892; 62/51.1

[58] Field of Search ..... 335/216; 62/51.1; 505/704–706, 879–880, 884–888, 892; 174/15.4, 15.5, 125.1

[56] References Cited

U.S. PATENT DOCUMENTS 4,241,233 12/1980 Bahder et al. ..... 174/15.4
5,105,626 4/1992 Gonczy et al. ..... 62/51.1
5,369,387 11/1994 Woods et al. ..... 335/216
5,436,606 7/1995 Cottevieille et al. ..... 335/216

FOREIGN PATENT DOCUMENTS 03232205 2/1990 Japan .

*Primary Examiner*—Lincoln Donovan
*Attorney, Agent, or Firm*—Helfgott & Karas, P.C.

[57] ABSTRACT

A superconducting magnet is accessible for ramping within a cryostat by inserting flexible current leads through openings in the cryostat and pushing and twisting these leads inward until connections are made with electrical contacts provided on the superconducting magnet. For each current lead, a permanently installed channel guides the lead as it is pushed through the external opening and extends to make contact with the magnet terminal. The guide channel extends outside of the cryostat and includes an internal or external bend, whereby the overhead space required for the cryostat/magnet assembly may be reduced. After ramping, the leads are withdrawn.

40 Claims, 4 Drawing Sheets

METHOD AND APPARATUS FOR CONNECTING HIGH CURRENT RAMPING LEADS TO A SUPERCONDUCTING MAGNET

BACKGROUND OF THE INVENTION

This invention relates generally to the ramping or upgrading in performance of an operating superconducting magnet, and more particularly relates to a method and apparatus providing improved high current connections to a superconducting magnet. As is known in the art, a superconducting magnet surrounded with liquid helium in an evacuated jacket, can operate with little maintenance over extended time periods when the apparatus has been constructed with high integrity to minimize heat gain and thereby to reduce consumption of helium.

Nevertheless, from time to time it becomes necessary to increase or decrease the superconductive current, that is, to charge or ramp, the superconducting magnet to restore a level of electrical performance that has slowly deteriorated, or to decrease the current to zero for service of other components. The interval between rampings in a well designed system may be a year or more. However, a need for ramping does inevitably arise.

The cryostat system including the magnet is designed with recognition that during the ramping procedure a charge of high current will be input to the magnet through connection terminals that are provided within the cryostat and are accessed, generally, through the top of the cryostat chamber. Access to the current terminals from the sides of the magnet or from below could also be provided. A fill port for helium is also generally provided at the top of the cryostat.

Desirably, permanent leads would be provided on the magnet, connected fixedly to terminals readily accessible from the outside of the cryostat for ramping purposes. However, this is an impractical concept. Such leads permanently extending from the cryogenically cold magnet towards the outer surfaces of the cryostat at room temperature would be a conduit for in-leakage of thermal energy that would result in substantially increased consumption of helium. Especially considering that ramping is a procedure that may not occur but once every year or two, it is desirable that minimization of heat in-leakage be achieved with priority over convenience in making electrical lead connections when ramping the superconducting magnet. Thus, it has become an accepted practice to use ramping leads that are connected only for actual ramping procedures, and then are removed.

A problem arises in many installations of superconducting magnets as a result of this necessity to occasionally adjust the magnet current. Namely, the requirement for access to the interior of the cryostat may affect ceiling space requirements at the installation. Clearance at the top of the cryostat/magnet assembly to permit the occasional access of ramping leads to the magnet in many installations will take away space that otherwise could be used for containing a larger cryostat/magnet assembly or a lower ceiling. In fact ceiling restrictions are an important limitation when installing magnets in a pre-existing facility. Thus the need for convenient ramping using high current carrying leads and the desire to optimize the magnet installation size are in contradiction.

What is needed is a method and apparatus for use in ramping a superconducting magnet whereby high current leads may be connected and disconnected to and from the magnet with reduced adverse effect on ceiling space requirements for the installation.

SUMMARY OF THE INVENTION

In accordance with the invention, a superconducting magnet is accessible for ramping within a cryostat by inserting flexible current leads through openings in the cryostat and pushing and twisting these leads inward until connections are made with electrical contacts provided on the superconducting magnet. For each current lead, a permanently installed channel guides the lead as it is pushed through the external opening and extends to make contact with the magnet terminal. The guide channel may or may not extend outside of the cryostat and includes an internal or external bend, whereby the overhead space required for the cryostat/magnet assembly may be reduced. After ramping, the leads are withdrawn.

Accordingly, it is an object of the invention to provide an improved method and apparatus for connecting high current ramping leads to an operating superconducting magnet located in a cryostat, with reduced overhead clearance requirements for the cryostat installation.

Another object of the invention is to provide an improved method and apparatus for connecting high current ramping leads to an operating superconducting magnet while maintaining low heat leakage into the cryostat.

Still another object of the invention is to provide an improved method and apparatus for connecting high current ramping leads to a superconducting magnet without requiring disassembly of the cryostat to access the terminal board on the magnet or the current connectors thereon.

The invention accordingly comprises the several steps and the relation of one or more of said steps with respect to each of the others, and the apparatus embodying features of construction, combinations of elements, and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF PREFERRED EMBODIMENTS

Figure 1:
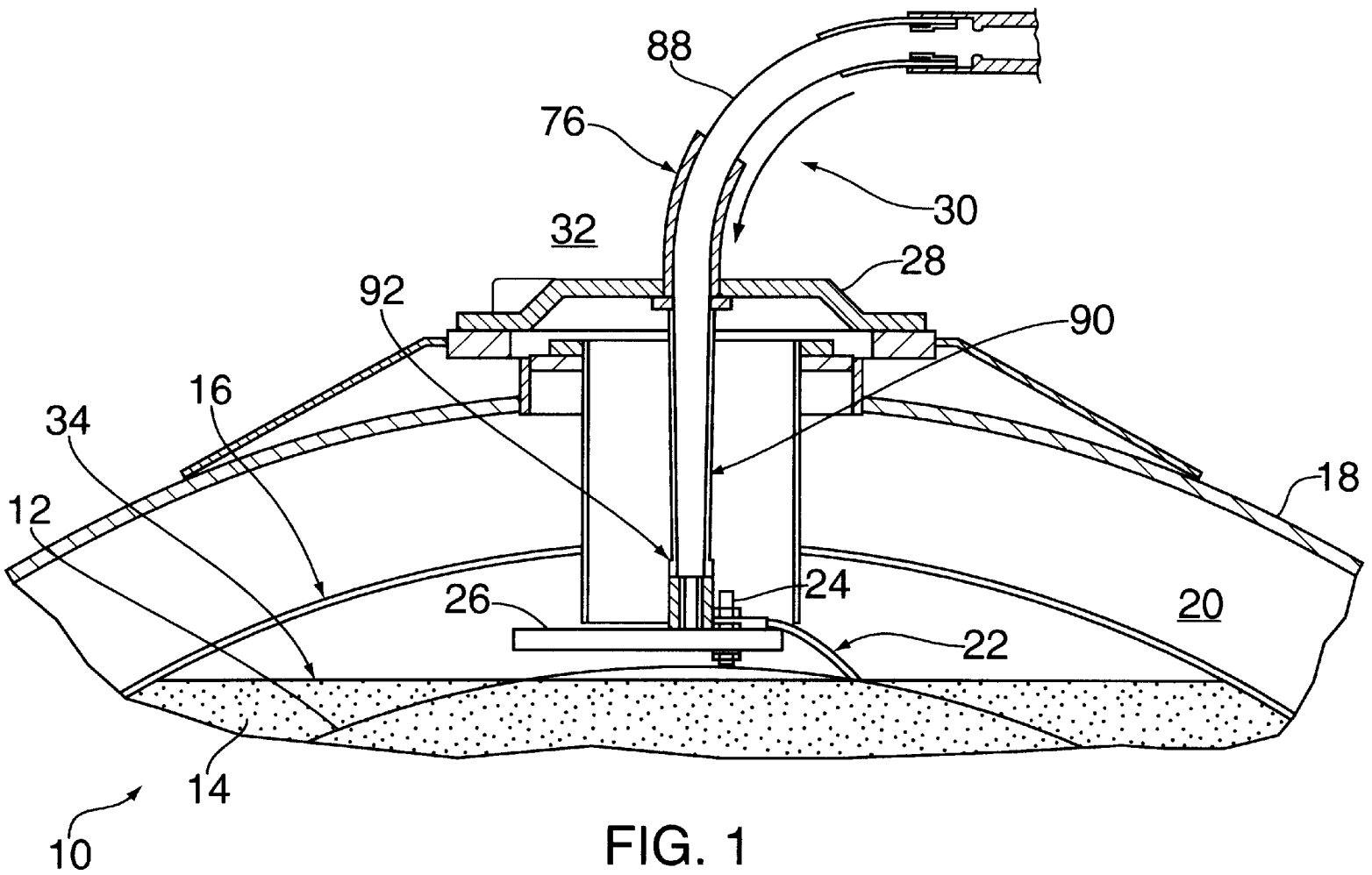
FIG. 1 is a fragmented schematic representation, partially sectioned, of a superconducting cryostat/magnet assembly incorporating the present invention.

With reference to FIG. 1, a cryostat/magnet assembly 10 in accordance with the invention includes a superconducting magnet 12 operating at temperatures near 4 degrees Kelvin in a bath of liquid helium 14 contained in a vessel 16. The magnet 12, liquid helium 14 and vessel 16 are at cryogenic temperature and contained within the cryostat/magnet jacket 18 that is thermodynamically isolated from the inner helium vessel by an evacuated space 20.

The cryostat/magnet assembly 10 as described above is conventional. It should be understood that the scope of the invention is not limited to superconducting magnets that are submerged in liquid helium. Other means of cooling may be utilized that do not require submersion in a liquid refrigerant.

A current lead 22 extends to the magnet 12 from a terminal lug 24 on a terminal board 26 that is located in the cold region within the helium vessel 16. At least two such power leads 22 are provided for activating the superconducting magnet 12 with current when initially put into operation and for ramping the magnet when performance has deteriorated after an extended period of operation. Access to the terminal board 26, terminal lug 24 and power leads 22 is provided through a magnet top plate 28.

A guidance support assembly 30 provides access from the external environment 32 at room temperature to the power leads 22 by way of the terminal board 26 and terminal lug 24 as described hereinafter.

The entire cryostat/magnet assembly 10 is constructed for minimum inleakage of heat with its corresponding low rate of helium consumption. Provision (not shown) may be made for addition of helium so as to maintain the helium liquid level 34 within a desired range, as is known to those skilled in the art.

Figure 2:
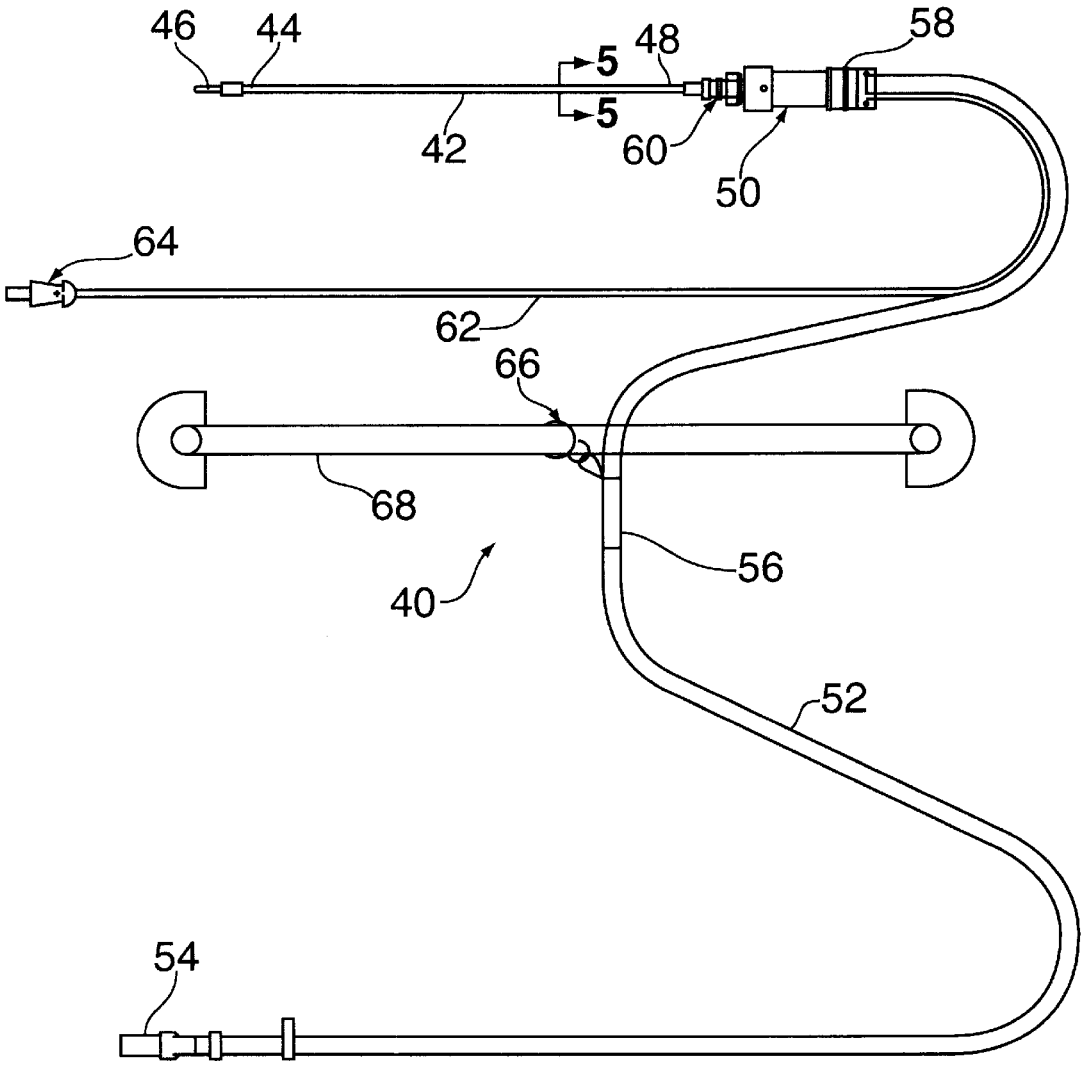
FIG. 2 is a high current ramping lead in accordance with the invention.

With reference to FIG. 2, a high current cable assembly 40 includes a flexible high current lead 42 that is capable of bending in a tight radius, for example, 150 mm (6 inches) and returning to its substantially straight condition when bending forces and constraints are removed. At its distal end 44, the high current lead 42 terminates in a lead pin 46, which is polarized, for example, by contour, so that a pair of cable assemblies 40 may be used for connection to positive and negative terminals of the superconducting magnet 12, without a possibility that a lead intended for one connection, for example, positive, will be used for the opposite polarity connection.

The proximal end 48 of the high current lead 42 is mechanically connected to a handle 50. From the other end of the handle 50 extends a conventional high current electrical cable 52 as is appropriate for the expected current load, which for superconducting magnets may be in the order of hundreds of amperes. A connector 54 at the remote end of the cable 52 is for connecting to an external current source (not shown) as will be used in ramping a superconducting magnet 12. Color coded identifiers (not shown) are provided on the handle 50 and connector 54 to clearly establish that the lead is the positive or negative lead, as the case may be. The connector 54 may be of any conventional type, for example, a high current twist lock connector.

A cable hanger 56 is attached to the extended length cable 52 so that, in use, the weight of the cable 52 can be borne by some mechanical structure of the cryostat assembly. Thereby unnecessary mechanical stress is eliminated at the connection between the high current cable assembly 40 and the cryostat assembly 10. A strain relief connection 58 of a conventional type is provided between the cable 52 and the handle 50.

In FIG. 2, the cable 52 is illustrated as suspended from a hook 66 that connects to the cable hanger 56 and is also connected to a fixed portion of the cryostat/magnet assembly 10, for example, a bracket 68.

A threadable sealing nut and ferrule combination 60 at the proximal end 48 of the high current lead 42 is provided to assure a hermetic connection when the cable assembly 40 is joined to the cryostat/magnet assembly 10.

A grounding cable 62 connects at one end to the handle 50 and terminates in a grounding plug 64 at the other end. The grounding cable 62 need only be provided on a negative polarity cable assembly 40. The ground cable is particular to this illustrated application and not necessary to the invention as claimed.

Figure 5:
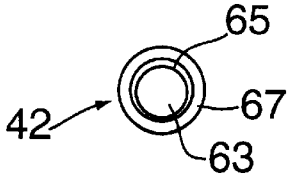
FIG. 5 is a section taken along the line 5—5 of FIG. 2.

The flexible high current lead 42 (FIG. 5) is a combination of a commercially available flexible drive shaft (core) 63 covered with a layer 65 of flexible copper braid, which, in turn, is covered by an outer abrasion jacket 67, for example, a polyester layer. The core drive shaft 63 is stainless steel, for example, as is manufactured by Elliott Manufacturing, Binghamton, N.Y. The copper braid 65 primarily carries the magnet charging current. The flexible core 63 provides strength for force transmission and twisting. The jacket 67 protects the copper 65 from damage during use and reduces sliding friction when using the current lead assembly 40.

Figure 3:
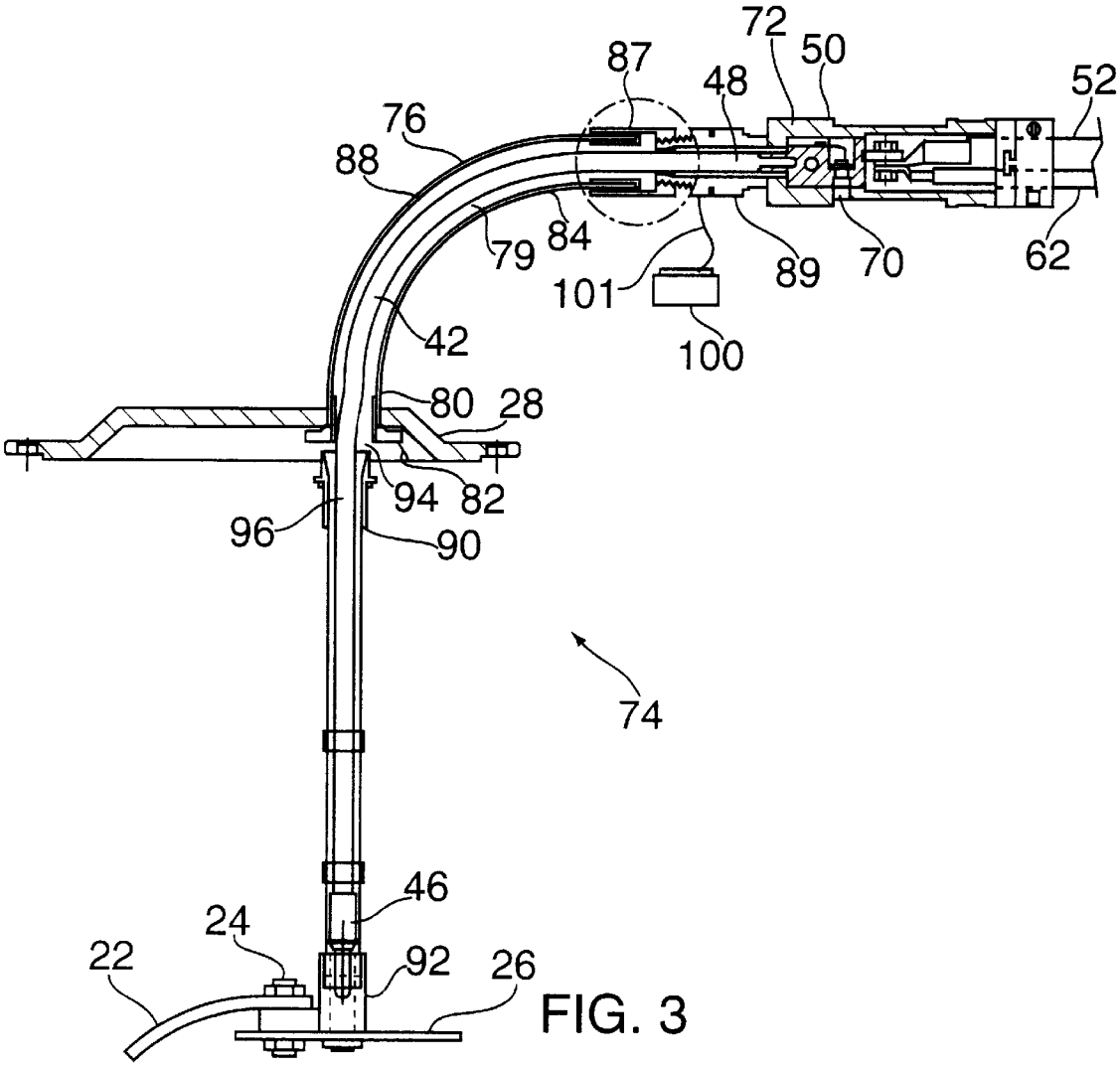
FIG. 3 is a partial elevation view in section illustrating the high current cable assembly of FIG. 2 connected to the terminal board of a superconducting magnet for the purpose of ramping the magnet.

As illustrated in FIG. 3, the grounding cable 62 connects within the handle 50 to the proximal end 48 of the high current lead 42. A voltage tap 70 (FIG. 3) connects by way of a protection resistor 72 to the high current lead 42 whereby it is possible to measure the voltage drop across the magnet where the lead pin 46 is connected to the superconducting magnet, for both leads.

A guidance support assembly 74 (FIG. 3) is fixed both internally and externally to the cryostat/magnet assembly 10 so that the high current flexible lead 42 may be connected to electrical current terminals 92 (only one is illustrated) on the internal terminal board 26 associated with the superconducting magnet 12, by entry into the cryostat assembly 10 from any preselected direction. In particular, externally of the cryostat, a lead access elbow 76 is fixedly connected to the magnet top plate 28. The inner end 80 of the lead access elbow 76 connects to a nipple 82 that extends from inside the cryostat, through the magnet top plate 28 to the ambient 32. The other end 84 of the lead access elbow 76 terminates with an internal pipe thread 86 on a sleeve 87 that mates with the male threaded end of the nipple 89. Thereby, a hermetic structure is formed between the magnet top plate 28 and the nipple 89.

The nut and ferrule assembly 60 in FIG. 2 mates with an external thread (not shown) at the end of the nipple 89 to hermetically join the lead access elbow 76 to the high current cable assembly 40 near the handle 50 for ramping the magnet. As stated, in either construction, and in any other connection that may be selected, a hermetic joint is provided between the lead access elbow 76 and the handle 50 when using the cable assembly 40.

Although not illustrated, at least two similar support assemblies 74 are used to provide access, respectively, to the positive and negative terminals of the magnet.

The lead access elbow 76, for example, constructed of aluminum, includes a 90 degree bend, the inner path or channel 79 defined by the elbow changing (FIG. 3) from a vertical direction to a horizontal direction. A low friction insulator layer 88, e.g. teflon, lines the inner surface of the lead access elbow 76 and reduces friction when the lead 42 and lead pin 46 are advanced through the lead access elbow 76. A guide tube 90, fixed at one end within the magnet top plate 28, continues the channel 79 formed by the lead access elbow 76. The channel continues from the top plate 28 to a magnet socket terminal 92 that protrudes from the terminal board 26 so that access is provided for current to the superconducting magnet by way of the lug 24 and lead 22.

A female socket terminal 92 is provided for mating with the lead pin 46 as illustrated. The guide tube 90 leads directly from the exit opening at the end 80 of the lead access elbow 76 to the magnet socket terminal 92 with a small gap 94 provided in the channel 79 to break the thermal path near the magnet top plate 28. A tapering inlet 96 assures that the lead pin 46 will successfully traverse the gap 94 as it travels through the internal channel 79 from the lead access elbow 76 to the guide tube 90.

Figure 4:
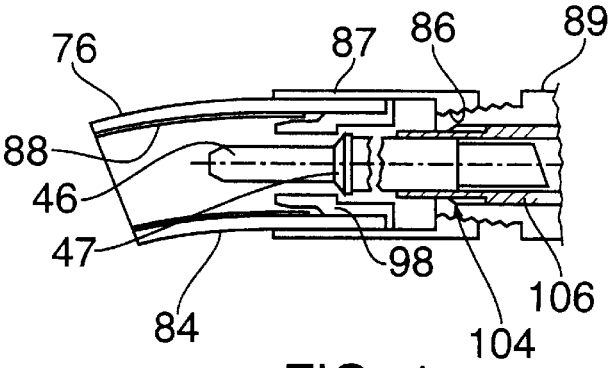
FIG. 4 is an enlarged portion of FIG. 3 illustrating mechanical connection features.

FIG. 4 illustrates how a positive lead port is constructed with a non-conducting polarizing ridge 98 (for example, fiberglass epoxy) that makes the center opening smaller than the conical end 47 of a negative lead pin 46. The ridge 98 obstructs entry to the lead access elbow 76 that connects to a positive terminal on the magnet. Thus the polarizing ridge 98 on the positive lead access elbow 76 does not permit entry of the lead pin 46 of a negative flexible lead 42. Many other constructions can be devised to dedicate each lead assembly to only one particular attachment polarity.

A plug 100, for example, of brass is attached by a thin safety wire or chain 101 so that the lead port at the end of the nipple 89 may be closed when current connection to the magnet is not required.

When current is to be supplied to the magnet socket terminal 92, the flexible lead 42 is inserted into the lead access elbow 76 and is pushed inwardly, being guided to the magnet socket terminal 92 by the lead access elbow 76 and the guide tube 90. As stated, the flexible lead 42 is electrically and thermally insulated from the lead access elbow 76 by the curved insulator liner 88 within the elbow 76. The liner 88, which may be replaceable, also provides low friction to allow easy access for the lead 42 and low wear on the flexible lead. The mating socket terminal 92, intended to receive the lead pin 46, is mounted on the magnet terminal board 26. This terminal connection is designed for minimum resistance to high electrical current and requires considerable force and twisting to make and break the connection. There is a stop 104 at the inner end 48 of the nipple 89 that is engaged by a collar 106 fixed on the flexible lead 42, when the lead pin 46 is fully seated in the magnet socket terminal 92.

The operator pushes the lead 42 into the lead port nipple 89 until the lead pin 46 is guided and seated in the magnet socket terminal 92. Pushing is done from the handle 50 and twisting may be applied to the handle, which rotates the flexible lead portion 42 and the lead pin 46 relative to the fixed socket terminal 92. Thereby, any accumulation of "ice", for example, frozen air, at the terminal may be penetrated and displaced in making the electrical connection.

In manufacture of ramping leads 40 for a particular cryostat/magnet installation 10, the nipple 89 is threaded and fixed at the position where the stop 104 will engage the collar 106 when the lead pin 46 has just properly seated in its socket terminal 92. That is, each cryostat may be constructed for lead length by adjusting the position of sleeve 87 and the lead access elbow 76 so that a single set of ramping leads may be used for many cryostat/magnet assemblies of similar type.

After the positive and negative leads 40 are installed by similar procedures, the operator can determine if good electrical contact has been established between the lead pins 46 and the magnet socket terminals 92 by using the voltage taps 70 that are provided on both leads and connect to points on the conductive flexible leads 42 adjacent to the lead pins 46. The voltage tap 70 is also color coded to correspond to the polarity of the lead assembly 40.

The magnet socket terminals 92 are at cryogenic temperature, whereas the entrance nipple 89 to the lead access elbow 76 will be at room ambient. In using the leads 40, they should be at room temperature and free of moisture when beginning the procedures.

After the superconducting magnet 12 has been ramped with current and is at the desired operating condition, the high current cable assembly 40 in accordance with the invention can be retracted from the guide tube 90 and lead access elbow 76 by reverse procedures in twisting and pulling on the handles 50. Then the plug 100 is placed over the entrance to the lead access nipple 89.

It should be understood that the procedures in using the high current cable assemblies of the present invention are precise in detail and must be carefully followed to avoid danger. Very high currents may be flowing during certain portions of the procedure. This patent application is not intended and should not be relied upon to describe usage procedures of the lead assemblies in detail, as the precise use procedures are not considered to be a novel portion of the present invention. Those skilled in the art of initiating and maintaining operation of cryostat/magnet assemblies of the superconducting type will be familiar with these procedures and the precautionary measures required to assure safety during these procedures.

Thus, in using the present invention, large overhead clearances are not required for the cryostat/magnet assembly because of the flexibility of the current leads and the physical guidance including a bend provided for the leads within the assembly. Installation and retraction of the current leads may be from any direction, up, down, or sideways, by selecting, when designing the cryostat/magnet facility, the orientation of the guide tubing and access elbow into which the conductive element is to be inserted. The bend, which is illustrated externally of the cryostat assembly, may be internal in an alternative embodiment of the invention. Also, in an alternative embodiment in accordance with the invention the guidance support assembly 30 is connected to either the top plate 28 or cryostat 18.

Additionally, in an alternative embodiment, the fixed path 79 may have more than one bend; the only requirement is that the curvatures can be followed by the flexible high current lead 42 and the lead pin 46. The lead 42 may move along, for example, an S-curved channel.

The path 79 may be circular in cross section, but need not be so limited.

Also, the flexible, bendable lead is not limited to use with a flexible drive of the commercial type indicated above. Any bendable/force transmitting and electrically-conductive device that can be fed into the open end of the lead access elbow 76 may be used, so long as compressive forces bring the lead to connection with the magnet socket terminal 92 and provide a good electrical conductor for high currents.

Figure 6:
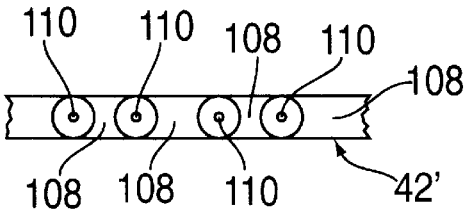
FIG. 6 illustrates an alternative construction in accordance with the invention of a high current lead.

Thus, a lead portion 42' in an alternative embodiment of the invention may be made of connected links that together lack rigidity or a given shape until they are inserted into the access elbow/guide tube channel 79 and are placed in compression. For example, a bicycle chain link type construction (FIG. 6) may be used with adjacent links 108 held together by pivot pins 110. Such a chain link type construction, unlike the flexible drive described above, would bend basically in a single plane whereas the above-described flexible drive element 42 that is not linked, may bend in different planes at different portions along its length.

In another embodiment in accordance with the invention, links in the core of a flexible drive may have ball and socket joints between them (as in children's "pop-it" beads).

In linked (articulated) leads, the links themselves may provide the electrical path or be sheathed, for example with braided copper, and be further covered with an electrically insulating covering, as in the above-described embodiments.

Additionally, it should be understood that the lead pin 46 and its connection with the magnet socket terminal 92 may be reversed with regard to the location of the male and female elements of the connection. Further, as some amount of rotation of the lead may be provided by rotating the handle 50, a threaded or bayonet-twist-type connection may be provided between the distal end of the lead 42 and the terminal board 26 and lug 24.

The high current cable assembly 40 and the high current flexible lead 42 are not fabricated of superconducting materials as the outer end of the lead is warm in use. However, in alternative embodiments use of super-conductors at the cold end of the flexible lead is not precluded.

A typical flexible lead 42 may be approximately 3 feet long; the cold end 46 may be a copper alloy, for example, a tellurium copper bronze (UNS19100), which is hard with low wear characteristics and is a good electrical conductor. Thus the cold end is suited for the compressive, twisting connection described above. The central core 63 of the flexible drive shaft 42 may be stainless steel covered with layers of braided copper and braided polyester, as described above. The handle is selected to be a good electrical insulator and to provide transfer of compressive force for lead insertion and torque when twisting the lead 40. A handle 50 that is two inches in diameter and able to transmit 100 to 200 inch-pounds of torque has been used effectively. The handle material may be a polyvinyl chloride.

Whereas the externally exposed access elbow 76 is made hermetic, it is not necessary that the guide tube 90 within the cryostat assembly be sealed. Thus, there may be openings in the guide tube 90 that communicate with its ambient within the cryostat assembly 10.

Figure 7:
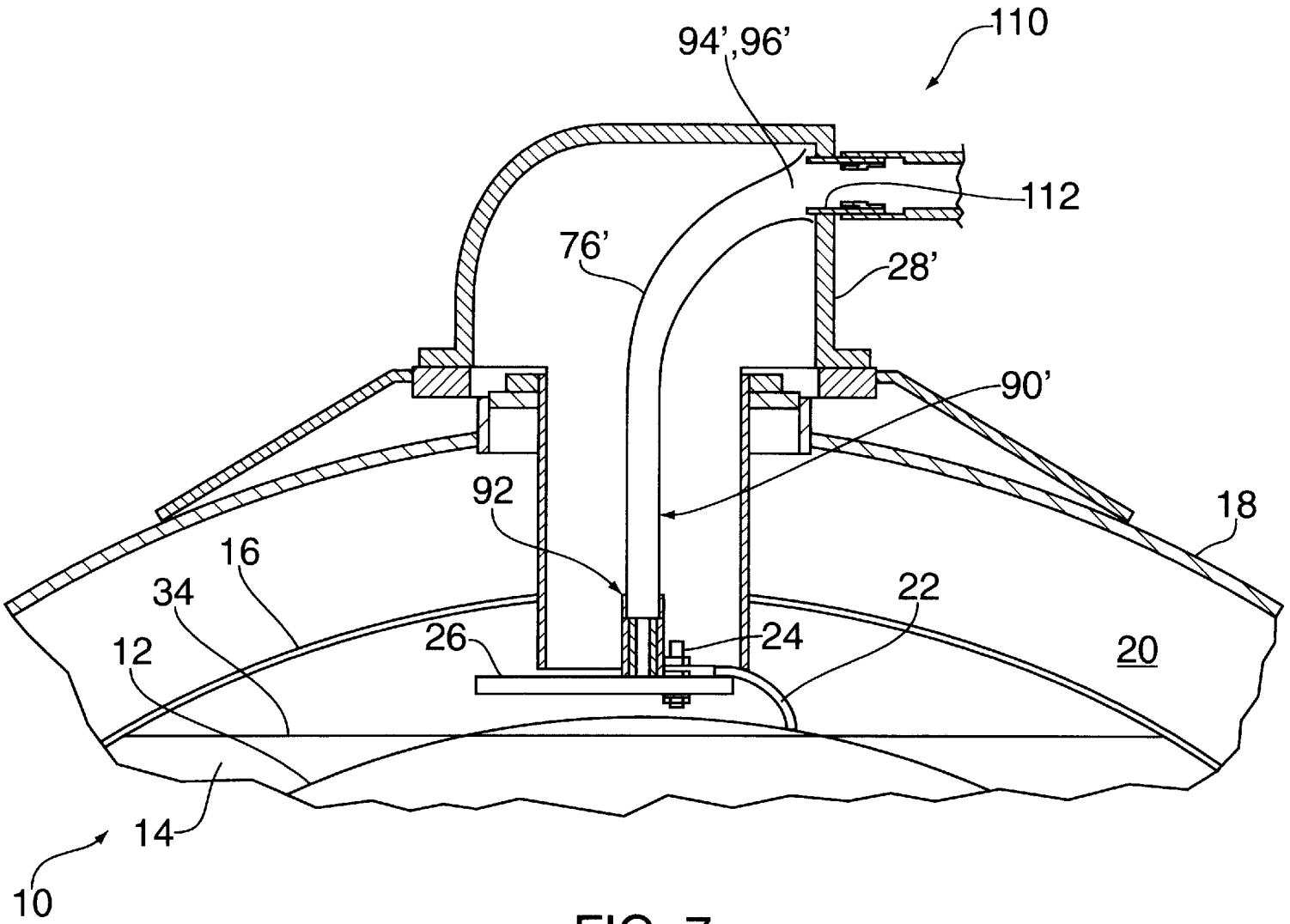
FIG. 7 is similar to FIG. 1 and illustrates an alternative embodiment of a cryostat/magnet assembly in accordance with the invention.

In FIG. 7, an alternative embodiment in accordance with the invention is illustrated. The construction is similar to that illustrated in FIG. 1 and the same reference numerals are used as appropriate. However, in FIG. 7 a magnet top plate 28' has greater height than the top plate 28 of FIG. 1. A hollow lead access elbow 76' extends from its connection at the magnet socket terminal 92 continuously to a side wall of the top plate 28'. A tube 112, e.g. aluminum, is hermetically fitted in the side wall of the top plate and terminates proximate the free end of the elbow 76'. The end 96' of the elbow 76' is flared and there is a gap 94' similar to the construction in FIG. 1 at 94, 96, so that a high current lead 42 passing through the tubing 112 will readily cross the gap 94' and enter the elbow 76'.

A coupling 110 for hermetic connection (as in FIG. 1) to a high current cable assembly 40 is provided at the outer end of the tubing 112. The elbow 76 provides a single continuous right angle bend element between the magnet terminal 92 and the magnet top plate 28'. The elbow 76' may be made of plastic, for example, fiberglass reinforced epoxy. Inclusion of the bend reduces the height of the installed cryostat/magnet assembly.

It will thus be seen that the objects set forth above, among those made apparent from the preceding description are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the general and specific features herein described, and all statements of the scope of the invention which, as a matter of language, might be said to fall therebetween.

What is claimed:

1. A cryostat/magnet assembly including a magnet in a cryostat for superconducting operation at low temperature, said cryostat/magnet assembly comprising;

a first electrical terminal connected to said magnet for use in applying current to said magnet, said first electrical terminal being connectable to an external current source via a lead terminal prior to said current application when current application is required;

a guide tube assembly extending within said cryostat from said first electrical terminal toward an external opening in said cryostat/magnet assembly and providing a channel for guiding said lead terminal to said first electrical terminal;

a high current cable assembly, said cable assembly including:

a deformable electrically conductive element of extended length having said lead terminal at one end for connecting to said first electrical terminal of said magnet, and a second end being for connection electrically to an electrical cable;

a handle positioned between said reformable electrically conductive element and said second end, said handle being mechanically connected at least to said electrically conductive element for transmitting at least one of compressive, tensile and torsional forces to said electrically conductive element, said forces being applied to said handle during use of said cable assembly.

2. A cryostat/magnet assembly as in claim 1, wherein said guide tube assembly includes one of a closed channel and a channel with at least one opening in an outer wall thereof.

3. A cryostat/magnet assembly, as in claim 1, wherein said guide tube assembly has a first end proximate said first electrical terminal and a second end, said guide channel assembly including at least one bend between said first end and said second end.

4. A cryostat/magnet assembly, as in claim 3, wherein said guide tube assembly is fixed in position at least at said first end.

5. A cryostat/magnet assembly, as in claim 2, wherein said guide tube assembly includes a tubing and said channel having said outer wall with at least one opening, said tubing being adjacent said first electrical terminal and being a thermally poor conductor and an electrically poor conductor.

6. A cryostat/magnet assembly, as in claim 2, wherein said guide tube assembly includes a low friction sliding surface on at least a portion of its interior.

7. A cryostat/magnet assembly, as in claim 6, wherein said low friction sliding surface is an insulator layer.

8. A cryostat/magnet assembly, as in claim 7, wherein said insulator layer is Teflon.

9. A cryostat/magnet assembly, as in claim 7, wherein said at least a portion of said inside surface includes said at least one bend.

10. A cryostat/magnet assembly, as in claim 3, wherein said guide tube assembly includes a thermal break in said channel between said first end and said second end.

11. A cryostat/magnet assembly, as in claim 3, wherein said second end of said guide tube assembly is outside said cryostat.

12. A cryostat/magnet assembly as in claim 1, wherein said electrically conductive element is at least one of flexible and articulated.

13. A cryostat/magnet assembly as in claim 12, wherein said electrically conductive element is elastically flexible and includes a flexible core with an electrical conductor on an external surface of said core.

14. A cryostat/magnet assembly as in claim 13, wherein said flexible core includes metal and said electrical conductor includes copper.

15. A cryostat/magnet assembly as in claim 14, wherein said core is steel and said electrical conductor is a copper braid encircling said core.

16. A cryostat/magnet assembly as in claim 13, further comprising an electrical insulator over said electrical conductor and said core.

17. A cryostat/magnet assembly as in claim 12, wherein said electrically conductive element is articulated, including links connected by joints.

18. A cryostat/magnet assembly as in claim 16, further comprising a tap on said handle for use in measuring voltage, said tap being connected electrically to said first end of said electrically conductive element, voltage at said electrical terminal of said magnet being measurable at said tap.

19. A cryostat/magnet assembly as in claim 18, further comprising an electrical resistance element between said tap and said first end of said electrically conductive element.

20. A cryostat/magnet assembly as in claim 1, wherein said guide tube assembly has a first end proximate said first electrical terminal and a second end, said guide tube assembly including at least one bend between said first end and said second end, said deformable electrically conductive element, in use, following said at least one bend when extended in said channel in said guide tube assembly from said external opening to said first electrical terminal.

21. A cryostat/magnet assembly as in claim 20, wherein said second end of said guide tube assembly is outside said cryostat.

22. A cryostat/magnet assembly as in claim 21, wherein at least one said bend is one of outside and inside said cryostat.

23. A method for applying current to a cryostat/magnet assembly including a magnet in a cryostat for superconducting operation at low temperature, comprising the steps of:

providing a first electrical terminal inside said cryostat connected to said magnet for use in applying said current to said magnet;

providing an external opening in said cryostat/magnet assembly allowing access from the outside of said cryostat to said first electrical terminal;

providing a guide channel extending between said first electrical terminal and said external opening for guiding a conductive element to said first electrical terminal;

providing a high current cable assembly including a deformable electrically conductive element of extended length having a lead terminal at one end for connecting to said first electrical terminal of said magnet and a second end for connecting electrically to an electrical cable; and a handle positioned between said deformable electrically conductive element and said electrical cable, said handle being mechanically connected at least to said electrically conductive element for transmitting at least one of compressive, tensile and torsional forces to said electrically conductive element;

inserting said conductive element through said external opening and guiding said conductive element along a path defined by said guide channel until said conductive element electrically connects to said electrical terminal by applying at least one of said forces to said handle; and applying a current source to said magnet via said connected conductive element.

24. A method as in claim 23, wherein said guide channel extends outside of said cryostat from said external opening, said outside portion of said guide channel being hermetic with said cryostat.

25. A method as in claim 23, wherein said guide channel includes at least one bend between one end of said channel proximate said electrical terminal and another end of said channel, which another end is outside said cryostat.

26. A method as in claim 24, wherein said guide channel includes at least one bend between one end of said channel proximate said electrical terminal and another end of said channel, which another end is outside said cryostat.

27. A method as in claim 26, wherein said at least one bend is one of outside and inside said cryostat.

28. A method as in claim 23, wherein said guide channel is defined by a tubular cross section and at least a portion of said guide channel has an interior with a low friction sliding surface.

29. A method as in claim 23, wherein at least a portion of said guide channel has an interior with a low friction sliding surface.

30. A cryostat/magnet assembly as in claim 1, said cable assembly further including an electrical cable connected to said electrically conductive element at said second end.

31. A cable assembly as in claim 23, wherein said electrically conductive element is at least one of flexible and articulated.

32. A cryostat assembly including a device in a cryostat for operation at low temperature, electrical connection to said device from outside said cryostat being at least intermittently required, said cryostat assembly comprising;

a first electrical terminal connected to said device for use in making said at least intermittent connection, said first electrical terminal being connectable from outside via a lead terminal;

a guide tube assembly extending within said cryostat from said first electrical terminal toward an external opening in said cryostat assembly and providing a channel for guiding said lead terminal to said first electrical terminal;

a cable assembly, said cable assembly including:

a deformable electrically conductive element of extended length having said lead terminal at one end for connecting to said first electrical terminal of said device, and a second end for connection electrically outside said cryostat; and a handle positioned between said deformable electrically conductive element and said second end, said handle being mechanically connected at least to said electrically conductive element for transmitting at least one of compressive, tensile and torsional forces to said electrically conductive element, said forces being applied to said handle during use of said cable assembly.

33. A cryostat assembly, as in claim 32, wherein said guide tube assembly has a first end proximate said first electrical terminal and a second end, said guide channel assembly including at least one bend between said first end and said second end.

34. A cryostat assembly as in claim 32, wherein said electrically conductive element is at least one of flexible and articulated.

35. A cryostat assembly as in claim 34, wherein said electrically conductive element is elastically flexible and includes a flexible core with an electrical conductor on an external surface of said core, and an electrical insulator over said electrical conductor and said core.

36. A cryostat assembly, as in claim 32, wherein said second end of said guide tube assembly is outside said cryostat.

37. A cryostat assembly as in claim 34, wherein said electrically conductive element is articulated, including links connected by joints.

38. A method for electrically connecting to a cryostat assembly including a device in a cryostat for operation at low temperature, comprising the steps of:

providing a first electrical terminal connected to said device inside said cryostat;

providing an external opening in said cryostat assembly allowing access from the outside of said cryostat to said first electrical terminal;

providing a guide channel extending between said first electrical terminal and said external opening for guiding a conductive element to said first electrical terminal;

providing a cable assembly, including a deformable electrically conductive element of extended length having a lead terminal at one end for connecting to said first electrical terminal of said device and a second end for connection electrically outside said cryostat, and a handle positioned between said deformable electrically conductive element and said second end, said handle being mechanically connected at least to said electrically conductive element for transmitting at least one of compressive, tensile and torsional forces to said electrically conductive element in use of said cable assembly, said forces being applied to said handle; and inserting said conductive element through said external opening and guiding said conductive element along a path defined by said guide channel until said conductive element electrically connects to said electrical terminal by applying at least one of said forces to said handle.

39. A method as in claim 38, wherein said electrically conductive element is at least one of flexible and articulated.

40. A cryostat/magnet assembly as in claim 1, wherein said lead terminal is releasibly and reversibly connected with said first electrical terminal of said magnet.

* * * * *